United States Patent [19]

Doyen

[11] Patent Number: 4,796,327

[45] Date of Patent: Jan. 10, 1989

[54] APPARATUS FOR PICKING UP DOG EXCREMENT

[75] Inventor: Hans H. Doyen, Neustadt-Gimmeldingen, Fed. Rep. of Germany

[73] Assignee: Ing. Alfred Schmidt GmbH, Fed. Rep. of Germany

[21] Appl. No.: 100,208

[22] Filed: Sep. 23, 1987

[30] Foreign Application Priority Data

Sep. 26, 1986 [DE] Fed. Rep. of Germany ..... 3632787

[51] Int. Cl.[4] ..... E01H 1/08

[52] U.S. Cl. ..... 15/340.3; 15/328; 15/331

[58] Field of Search ..... 15/328, 331, 334, 337, 15/340

[56] References Cited

U.S. PATENT DOCUMENTS

| | | | |
|---|---|---|---|
| 1,016,263 | 2/1912 | Green | 15/340 |
| 1,560,612 | 11/1925 | Sims | 15/340 X |
| 2,657,416 | 11/1953 | Smith | 15/331 |
| 4,457,043 | 7/1984 | Oeberg et al. | 15/340 |

FOREIGN PATENT DOCUMENTS

| | | | |
|---|---|---|---|
| 1190970 | 4/1965 | Fed. Rep. of Germany | 15/340 |
| 2554841 | 11/1983 | France | 15/321 |
| 938730 | 10/1963 | United Kingdom | 15/340 |

*Primary Examiner*—Chris K. Moore

[57] ABSTRACT

In an apparatus for picking up dog excrement in conjuction with a street sweeper, which picks up by suction over a suction duct, a separating container for the dog excrement picked up is connected ahead of the dirt container of the street sweeper, the two containers being joined to each other over a suction line. By these means, contamination of the sweeper is avoided.

4 Claims, 1 Drawing Sheet

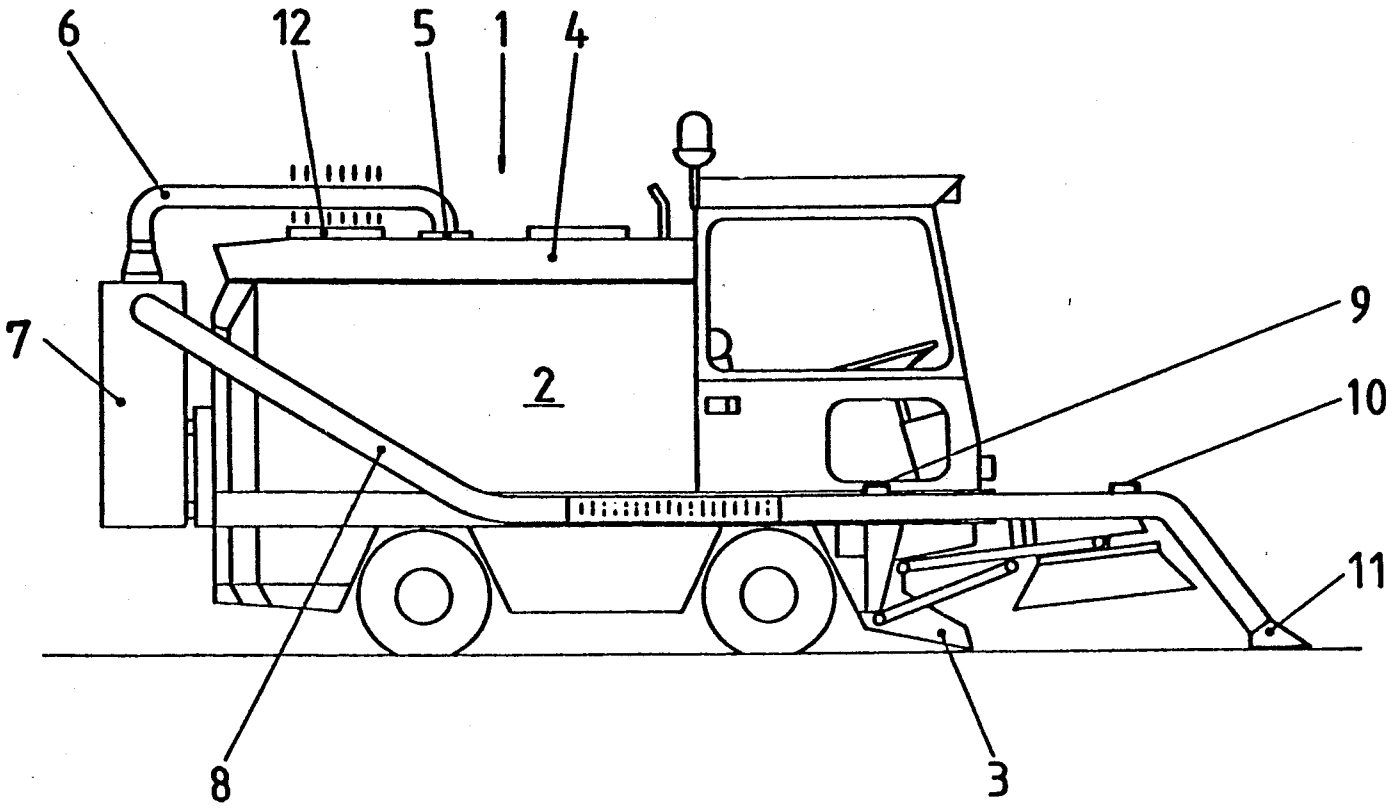
9
10
11
3
4
1
2
5
12
8
6
7

APPARATUS FOR PICKING UP DOG EXCREMENT

The invention is directed to an apparatus for picking up dog excrement in conjunction with a street sweeper, which picks dirt up by suction through a suction duct.

In addition to their unremovably installed pick-up device, such street sweepers usually are equipped with a suction hose, which can be connected over a connecting piece with the dirt container. The dirt picked up by the suction hose, such as leaves, reaches the main container directly in this manner. If dog excrement is picked up with this suction hose, it contaminates the conduction paths and the cover screen; moreover, a considerable objectionable odor, which is of concern at least to the crew, is unavoidable.

As opposed to this, it is an object of the present invention to provide an apparatus of the initially named type, which, although it can be operated when coupled with the dirt container of the street sweeper, nevertheless avoids contaminating the sweeper with dog excrement.

This objective is accomplished by the proposal of the invention as defined in claim 1. The separating container is connected in the suction line ahead of the dirt container and is preferably mounted on the outside of the sweeper or its dirt container. More specifically, the separating container is connected by means of the suction line with the suction zone of the dirt container, so that it does not require its own suction unit. The separating container may, however, also be installed at any convenient point between a suction nose piece of the suction duct, which is fixedly attached to the street sweeper, and the dirt container of the street sweeper, for example, in the interior of the dirt container at the end of the suction duct.

However, in a preferred embodiment of the invention, which is advantageous for retrofitting existing sweepers, the separating container is installed on the outside of the dirt container and has its own suction connection for picking up the dog excrement.

In street sweeping machines, in which an additional connecting piece for a suction hose, which can be used instead of the fixedly mounted suction duct, is provided at the dirt container, the separating container may advantageously be joined over a suction line connected over the connecting piece to the dirt container and the suction hose may be connected to the separating container.

For separating the dog excrement, it is advisable that air-conducting devices be provided in the separating container. By means of these air-conducting devices, the aspirated excrement components are separated from the suction stream.

The appartus of the invention can be operated either by the driver of the street sweeper himself or by a helper. In this connection, it may be appropriate to support the suction hose, which is connected to the separating container, at a tiltable derrick, which is provided on the street sweeper.

An example of the operation of the invention is described in the following by means of a drawing. This drawing shows a street sweeper (1) with a dirt container (2) and a pick-up device (3) disposed at its front end. At the cover (4) of the dirt container (2), a connecting piece (5) for a conventional suction hose is provided.

Instead of the conventional suction hose, a suction line (6), which connects the dirt container (2) with a separating container (7), is provided in the embodiment shown in the drawing. The separating container (7) is mounted on the rear end of the street sweeper. A suction hose (8) is connected to the separating container (7). This suction hose (8) is led along the vehicle to the front and ends in a nose piece (11) for picking up the dog excrement.

Two handles (9, 10) are provided on the suction hose (8). The rear handle (9) is used by the driver of the vehicle to operate the suction hose (8). The front handle (10) is intended for an additional operator, who walks alongside the sweeper. The suction hose (8) may be of flexible construction and reinforced over a portion of its length or over certain longitudinal segments or it may be held by derrick-like support devices, which are not shown in the drawing. The dog excrement, picked up by the nose piece (11), thus passes through the suction hose (8) into the separating container (7), where it is separated from the suction stream. The suction stream, freed from dog excrement, passes through the suction line (6) into the dirt container (2) and from there over the blower (12) of the dirt container (2) into the atmosphere.

Control by the driver of the suction hose (8) with, for example, rear handle (9) comes into consideration especially for smaller street sweepers, such as those used in the inner city area, perhaps for the cleaning of sidewalks.

I claim:

1. An apparatus for picking up dog excrement in combination with a self-propelled street sweeper, comprising a dirt container and a pick-up device cooperating with sweep brushes and being positioned below said dirt container and connected directly to said dirt container to convey picked up dirt thereinto, said dirt container including a cover and a connecting piece mounted on said cover, a separating container attached to said dirt container; a suction line connecting said separating container to said connecting piece; and a suction hose having one end opening into said separating container and another end terminating with a nose piece to pick up the dog excrement which is conveyed into said separating container through said suction hose and is separated therein from a suction stream so that the suction stream freed from the dog excrement passes through said suction line into said dirt container.

2. An apparatus according to claim 1, further including means for operating said suction hose.

3. An apparatus according to claim 2, wherein said suction hose is led along the street sweeper toward a front end thereof, said operating means including two handles, at least one of said handles being mounted to allow a driver of the street sweeper to operate said suction hose.

4. An apparatus according to claim 1, wherein air-conducting devices are provided, by means of which aspirated excrement components are separated from the suction stream.

* * * * *